US006113168A

United States Patent [19]

St. Jeor

[11] Patent Number: 6,113,168

[45] Date of Patent: Sep. 5, 2000

[54] COMPACT SNOW DIGGING IMPLEMENT

[75] Inventor: Chris St. Jeor, Salt Lake City, Utah

[73] Assignee: Innovations du Jeor, LLC, Salt Lake City, Utah

[21] Appl. No.: 09/383,868

[22] Filed: Aug. 26, 1999

Related U.S. Application Data

[63] Continuation-in-part of application No. 09/160,649, Sep. 25, 1998, abandoned.

[51] Int. Cl.[7] ..... E01H 5/02

[52] U.S. Cl. ..... 294/54.5; 37/285

[58] Field of Search ..... 294/1.1, 1.3, 54.5, 294/55; 248/99; 37/365, 278, 284, 285; 141/10, 108, 109, 114, 314

[56] References Cited

U.S. PATENT DOCUMENTS

| | | | |
|---|---|---|---|
| 112,727 | 3/1871 | Lum | 141/108 |
| 2,613,977 | 10/1952 | Kellogg . | |
| 3,936,087 | 2/1976 | Alexander . | |
| 4,245,411 | 1/1981 | McMath . | |
| 4,516,799 | 5/1985 | O'Donnell . | |
| 4,607,872 | 8/1986 | Herner . | |
| 4,749,011 | 6/1988 | Rylander . | |
| 4,760,982 | 8/1988 | Cooke | 294/1.1 |
| 4,854,624 | 8/1989 | Baymiller . | |
| 5,056,245 | 10/1991 | Jenkins et al. . | |
| 5,575,315 | 11/1996 | Wengert . | |
| 5,673,734 | 10/1997 | Hawley . | |
| 5,879,039 | 3/1999 | Baker et al. | 294/55 |
| 5,951,079 | 9/1999 | Winskye | 294/55 |

*Primary Examiner*—Dean J. Kramer
*Attorney, Agent, or Firm*—Thorpe, North & Western, LLP

[57] ABSTRACT

A lightweight, compact implement for digging snow, comprising a substantially flat sheet of flexible, resilient material having a front face, a back face, a top edge, a bottom edge, a right edge, and a left edge, and handles situated near the right edge and the left edge thereof, whereby a user grasping the sheet by the handles may selectively deform the sheet into a shovel head shape and use it to cut and transport volumes of snow using the top edge or bottom edge. The handles may comprise oblong hand holes formed near the right and left edges of the sheet, or may comprise handles or straps affixed near the edges. The top edge is short and rounded so as to facilitate digging of hard or packed snow, while the bottom edge is longer and less rounded to allow digging of comparatively larger volumes of light or soft snow.

20 Claims, 5 Drawing Sheets

COMPACT SNOW DIGGING IMPLEMENT

This application is a continuation-in-part of U.S. patent application Ser. No. 09/160,649, filed on Sep. 25, 1998 now abandoned.

BACKGROUND OF THE INVENTION

1. Field of the Invention

This invention relates to implements for digging snow. More particularly, the invention relates to a small, lightweight, portable snow digging device that is easier to store and transport by campers, hikers, skiers, snowmobilers, and others who venture into remote or back-country areas in winter.

2. State of the Art

Small, lightweight shovels for use by campers, hikers, skiers, sportsmen, and the like are well known. Many varieties of these shovels are available, including lightweight models designed specifically as snow shovels. However, those currently known are typically made of a rigid material, and include some sort of rigid elongate handle. This configuration makes these shovels unwieldy and difficult to transport in many instances. For example, a conventional portable snow shovel must normally be attached to the outside of a hiker's pack because of its large/odd shape. Shovel heads made of a rigid polymer material also have a tendency to break if a user attempts to force them into a too small or wrongly shaped storage space, or if the storage container is crushed. There is thus a genuine need for a lighter-weight, portable snow shovel that is flexible and can be easily transported inside a backpack or similar small, soft container.

Some conventional lightweight portable snow shovels incorporate a folding mechanism at the base of the handle. This arrangement allows the shovel to be folded into a more compact shape for transport, but also requires the provision of a complicated latching hinge mechanism connecting the base of the handle to the shovel head. Because the bending stresses in the handle of the shovel are greatest at the base of the handle, such mechanisms tend to be either heavy, complicated, and bulky, or else they are insufficient to handle the possible stresses incurred during use of the implement, and quickly break. There is a genuine need for a lightweight, portable snow shovel that does not present the unwieldy shape of conventional shovels, and does not require a complicated and heavy folding latch mechanism at a handle base.

An elongate handle also presents use problems in certain instances. For example, a winter camper attempting to excavate a snow cave with a conventional shovel will find it difficult to maneuver the shovel in the cramped space inside such a cave, making construction errors or mishaps much more likely. For such applications there is a need for a compact snow shovel that is lightweight and easy to use in cramped quarters.

Conventional snow shovels are also somewhat limited in their manner of use because the rigid, formed shovel head is separated from the hands of the user by the length of the handle, and the shovel head is of a fixed shape. Because of the principles of leverage, the separation of the shovel head from the hands of the user can reduce the effectiveness of the tool in certain desirable operations.

In addition, the fixed shape of the shovel head reduces its versatility. First, from a purely mechanical standpoint, a rigid material formed into a specific shape will have a fixed strength in any dimension. This strength is measured as a function of the moment of inertia of the cross-sectional shape of the shovel head. Additionally, conventional snow shovels have only a single cutting blade of a fixed size and shape. It is well known that the cutting action of blades and the like is partly the result of a given force being applied to a very small area (the edge of the blade) so as to impose a very large stress to the surface the substance to be cut. In the case of snow shovels, the force required to cut into snow of a given density will depend on the surface area of the blade that is brought into contact with the surface of the snow. With a conventional snow shovel having a blade of a fixed length, such a shovel will be adapted to cut snow only up to a certain hardness. When harder, icier snow is encountered, the shovel becomes useless because at some point the user cannot apply sufficient force to generate a cutting stress.

If a user were able to selectively modify the shape of the shovel head so as to increase its moment of inertia, the user could advantageously use such a snow shovel in a wider variety of snow hardness conditions. Similarly, if a user could alter the shape of a blade or select from more than one cutting blade to use, that user could efficiently deal with a wide variety of snow conditions. For example, a broad flat shovel head and long cutting edge would be adequate for shoveling and cutting light or soft snow, and would allow relatively large volumes to be moved with any given motion. On the other hand, the shovel head could be adapted for cutting and shoveling hard packed or icy snow by deforming the head to increase its moment of inertia, and applying a shorter cutting edge, and hence imparting a greater cutting stress, to the surface of the snow.

OBJECTS AND SUMMARY OF THE INVENTION

It is therefore an object of the invention to provide a lightweight, portable snow shovel that can be easily transported inside a backpack or similar small, soft container.

It is another object of the invention to provide a compact snow shovel that is flexible.

It is a further object of the invention to provide a compact snow shovel that is easy to use in cramped quarters.

It is an additional object of the invention to provide a lightweight, portable snow shovel that does not present the unwieldy shape of conventional shovels, and does not require a complicated and heavy folding latch mechanism at a handle base.

It is yet another object of the invention to provide a lightweight, portable snow shovel wherein a user may selectively modify the shape of the shovel head so as to increase its moment of inertia, allowing the shovel head to be used against harder snow and ice.

It is also an object of the invention to provide a lightweight, portable snow shovel wherein a user may selectively alter the shape of the cutting blade, or select from more than one cutting blade to use, allowing the shovel head to be used against harder snow and ice.

The above and other objects are realized in a compact apparatus for shoveling snow comprising a substantially flat sheet of flexible, resilient material having a top edge and a bottom edge, a right edge and a left edge, and having grasping means situated near the right edge and the left edge of the sheet. A user may grasp the sheet by the grasping means to selectively deform the sheet into a shovel head shape and use it to cut and transport volumes of snow using the top edge or bottom edge. The top edge of the implement is shorter and more rounded compared to the bottom edge, such that when deformed into a shovel head shape the top edge will be suited to cut relatively hard or packed snow, and the bottom edge will allow for the transport of a larger amount of softer or loose snow.

Other objects and features of the present invention will be apparent to those skilled in the art, based on the following description, taken in combination with the accompanying drawings.

DETAILED DESCRIPTION OF THE PREFERRED EMBODIMENT

Figure 1:
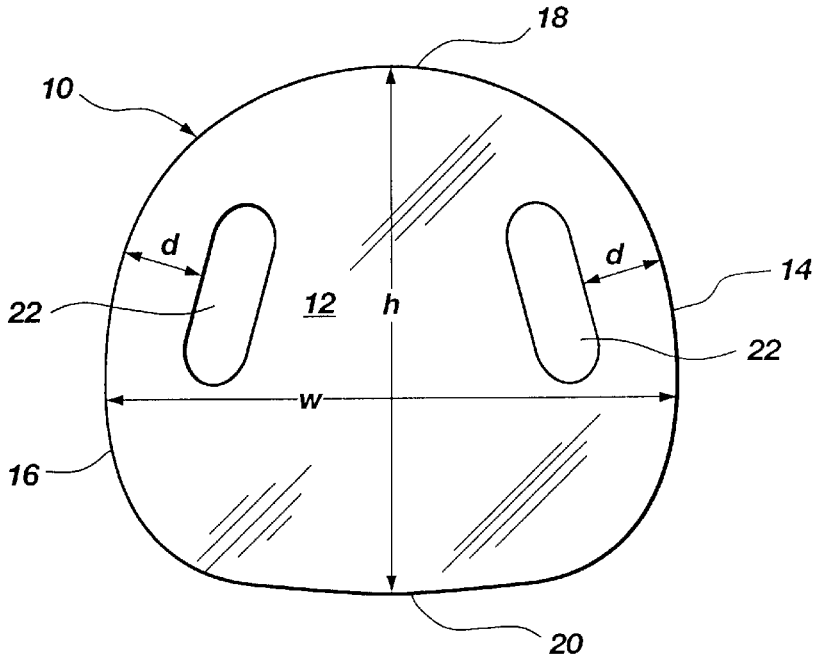
FIG. 1 depicts one embodiment of the present invention wherein the handles comprise oblong openings formed in the substantially flat sheet.

Referring now to the drawings, FIG. 1 depicts the snow digging implement, denoted generally at 10, formed of a substantially flat sheet 12 of a resilient, lightweight, flexible material. Many materials would be suitable for use, including metals and polymers such as polyethylene, polypropylene, polystyrene and nylon. Likewise, various thicknesses could be selected depending on the desired strength, cutting ability, and susceptibility to bending of the implement. In a preferred embodiment, the sheet 12 is formed of 0.05 mil. high density polyethylene (HDPE). The maximum height h and maximum width w of the sheet may vary, but for purposes of usability and portability are both preferred to be approximately 1 ft. Converting these approximate dimensions using standard density values known to those skilled in the art gives a weight of less than 4 oz. for the implement as depicted in FIG. 1. These dimensions have been found to provide a comfortable and easy to use implement that is large enough to move a reasonable volume of snow, yet small enough to be easily portable.

Because of its unique design, the invention thus provides a small, compact, and flexible shovel device that will fit into snow mobile compartments, small car trunks, ordinary backpacks, daypacks, and even some fannypacks. It is thus more convenient and simple to transport and use than conventional shovels. It is also lighter in weight and cheaper to manufacture than other snow shovels because it does not require a separate handle, and may be made from a flat sheet, rather than a fixed shape shovel head.

The sheet 12 has a right edge 14 and a left edge 16, a top edge l8, and a bottom edge 20.

The edges as shown are curvilinear. However, it will be apparent that the present invention could be formed with all or some of the edges straight, possibly even at right angles. In a preferred embodiment, the edges are almost entirely curved, though in varying degrees. The top edge 18 is the shortest and most curved edge. This is intended to give the top edge maximum cutting strength and power for use on hard, packed, and icy snow. The bottom edge 20, in contrast, is longer and straighter, making it more suited to cutting softer snow, and to digging and scooping larger volumes of snow. The curved sides 14 and 16 provide a gradual transition between the top and bottom edges.

Adjacent to the sides 14 and 16 are hand holes 22 formed in the flat sheet 12. These holes 22 are preferably oblong, roughly corresponding to the size and shape of a cross section of the human hand, and oriented close to and generally parallel with the sides. The distance d between the sides of the implement and the holes 22 may be any dimension that will be comfortable to grip, yet provide adequate strength for use as a handle. This distance d will necessarily depend on the type of material and thickness chosen for the implement, but in the preferred embodiment is from 1 to 1¾ inches. The hand holes 22 are also preferably angled as shown for comfort and ease of use, but may be formed at other angles or parallel to each other.

Figure 6:
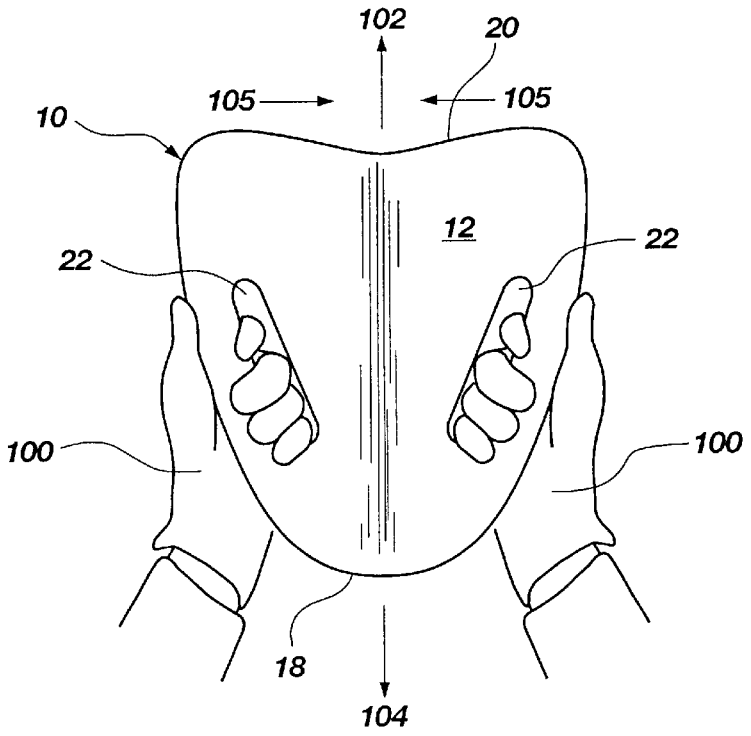
FIG. 6 shows a user's hands holding the snow digging implement of FIG. 1 with the top or short edge down so as to be able to dig hard snow by pulling, and with the bottom or long edge up so as to be able to shovel light or soft snow by pushing away from the user's body.
Figure 7:
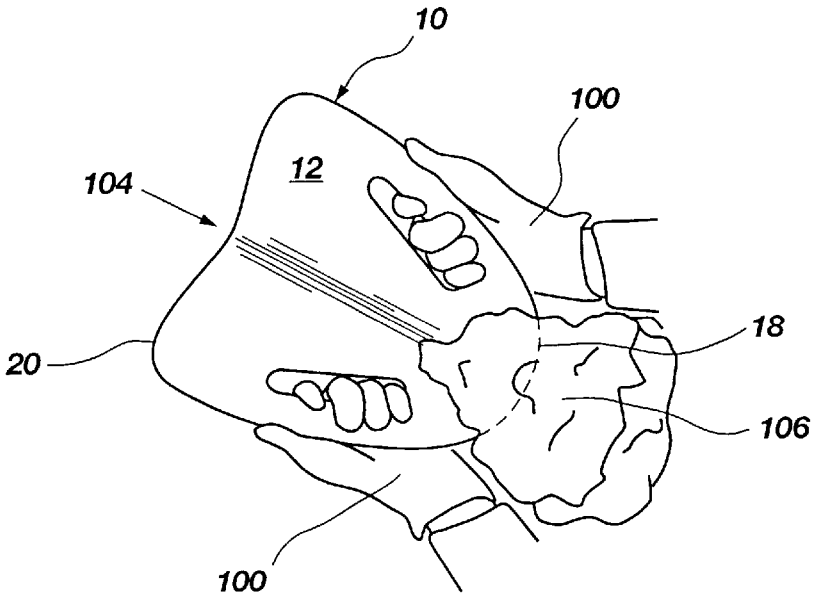
FIG. 7 shows a user's hands holding the implement of FIG. 1 and digging hard snow with the short edge of the implement.

With the implement 10 in the orientation shown in FIG. 1, or alternatively, inverted therefrom as shown in FIG. 6, a user may easily grasp the implement by the hand holes 22 as depicted in FIGS. 6 and 7. This is done by extending the palms of the hands around opposing edges 14 and 16 so that one palm generally engages one edge, the other palm engages the opposing edge, and the fingers pass around behind the implement and emerge through the hand holes 22. A secure grip may be ensured by gripping the inside of the hand holes with the fingers and closing the thumbs over the front of the fingers as shown in the figures.

Figure 2:
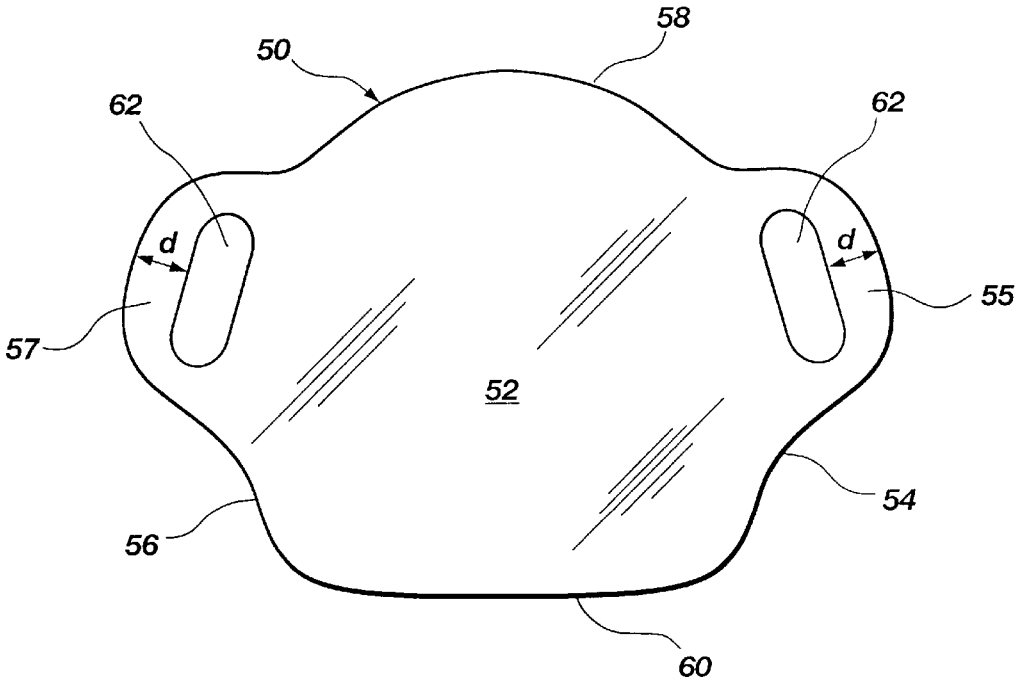
FIG. 2 shows an alternative embodiment of the present invention wherein the grasping means are disposed on flaps which extend from the sides of the implement.

FIG. 2 depicts an alternative embodiment of a snow digging implement 50 comprised of a substantially flat sheet 52 having a right side 54, a left side 56, a top edge 58, and bottom edge 60. In this embodiment the implement comprises flaps 55 and 57 which extend from the right side 54 and left side 56 respectively of the implement 50, and have hand holes 62 disposed therein. It will be apparent that in this embodiment, a given bending force applied to the hand holes 62 by a user will tend to deform the flaps 55 and 57 more than the body of the sheet 52 itself. These hand holes 62 are formed in the same manner as those described in FIG. 1 above, being located a similar distance d from the edge of the flaps 55 and 57.

Figure 3:
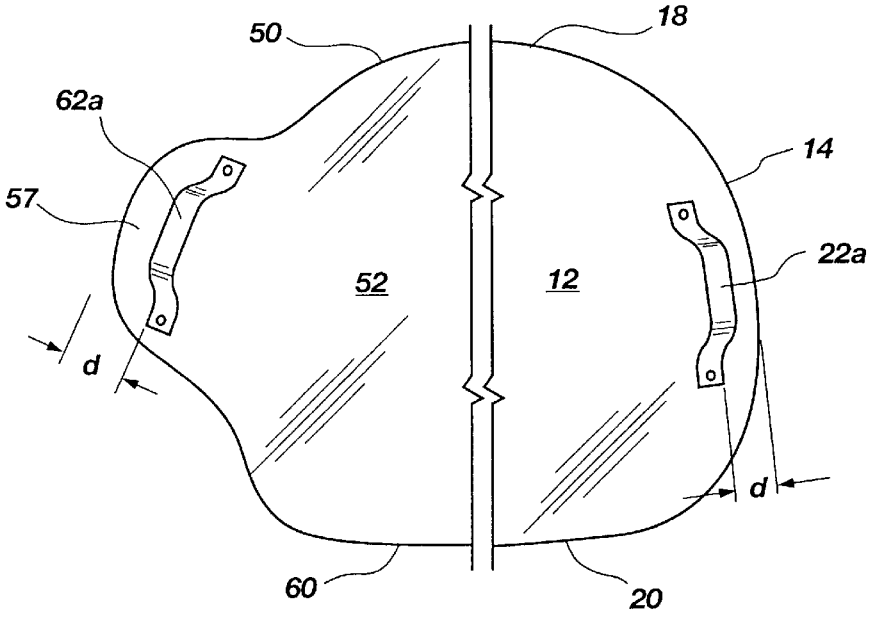
FIG. 3 shows the embodiment of FIG. 1 and FIG. 2 wherein separately formed handles are affixed near the edges of the implement.

FIG. 3 is a split view of the embodiments of FIG. 1 and FIG. 2 wherein the grasping means comprises separately formed handles which are affixed near the edges of the implement. On the right hand side of this figure, the sheet 12 of FIG. 1 has a raised handle 22*a* disposed near the right edge 14, rather than a hand hole 22. On the left side of the figure, the sheet 52 of FIG. 2 likewise has a raised handle 62*a* disposed on the flap 57 rather than a hand hole 62. It will be apparent that these raised handles may be affixed by any suitable means, such as adhesive or mechanical fasteners such as rivets, screws, etc.

Figure 4:
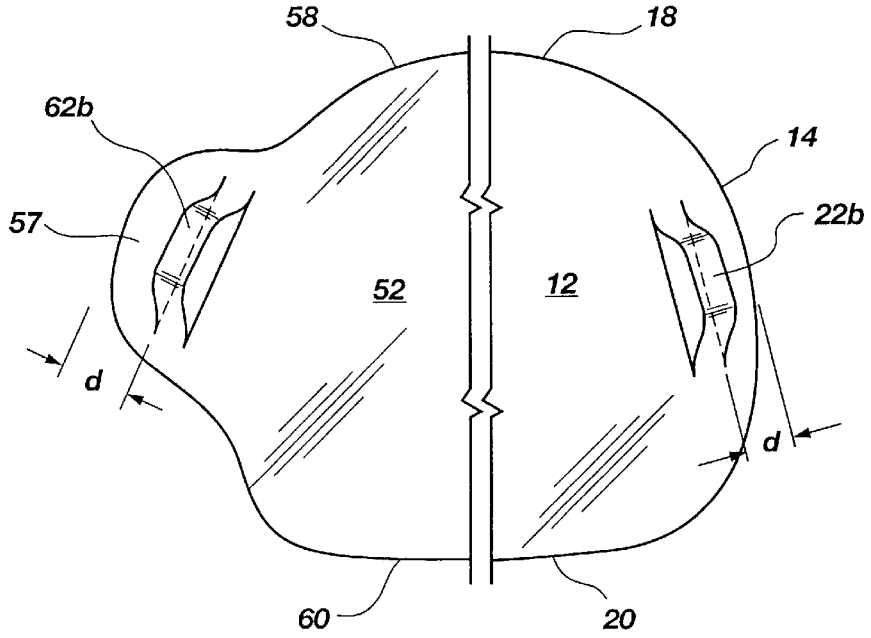
FIG. 4 shows the embodiment of FIG. 1 and FIG. 2 wherein the handles comprise raised handles integrally formed of the material of the sheet.

FIG. 4 shows another split view of the embodiments of FIG. 1 and FIG. 2 wherein the handles comprise raised handles integrally formed of the material of the sheet. On the right hand side of this figure, the sheet 12 of FIG. 1 has a raised handle 22*b* which is integrally formed of the material of the sheet and disposed near the right edge 14. On the left side of the figure, the sheet 52 of FIG. 2 likewise has a raised handle 62*b* integrally formed of the material of the sheet and disposed on the flap 57. It will be apparent that these raised handles are formed by a method of expansion wherein parallel cuts defining the sides of the handle are formed in the sheet, after which the handle is drawn away from the plane of the sheet by means of pressure and/or heat to form a handle shape, yet remain integrally a part of the material of the sheet at its ends.

Figure 5:
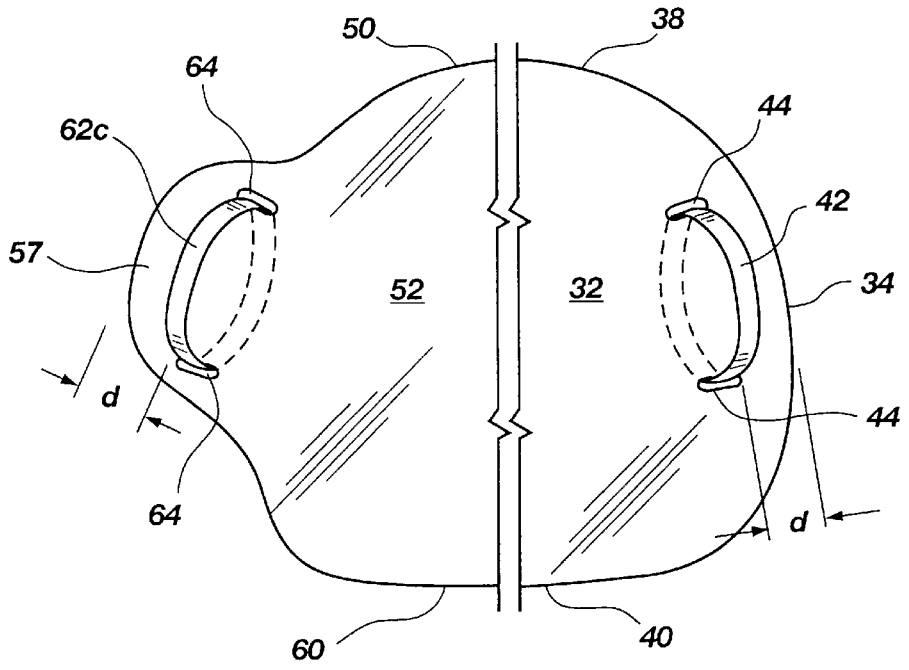
FIG. 5 shows the embodiment of FIG. 1 and FIG. 2 wherein the handles comprise continuous straps disposed through a first pair of parallel openings formed near the right edge of the sheet and a second pair of parallel openings formed near the left edge of the sheet.

FIG. 5 shows another split view of the embodiments of FIG. 1 and FIG. 2 wherein the handles comprise continuous straps disposed through pairs of parallel openings formed near the edges of the sheet. On the right hand side of this figure the flat sheet 32 has a continuous strap 42 which extends through a pair of small openings 44 formed near the edge 34, instead of a hand hole 22. The strap 42 is oriented generally parallel to the side 34, just as are the hand holes 22, and raised handles 22*a* and 22*b*. On the left side of the figure, the sheet 52 of FIG. 2 likewise has a continuous strap 62*c* disposed through a pair of openings 64 formed in the flap 57. The continuous straps 42 and 62*c* are preferably formed of a strong, flexible material such as nylon that is easily grasped by a user's hands. It will be apparent to those skilled in the art that there are many additional methods of providing suitable handholds that are consistent with the present invention.

FIG. 6 shows a user's hands holding the snow digging implement of FIG. 1 with the top or short edge down so as to be able to dig hard snow by pulling, and with the bottom or long edge up so as to be able to shovel light or soft snow by pushing away from the user's body. The snow digging implement of the present invention is used by grasping the sides of the implement through the hand holes 22 (or handles if provided), and digging, chopping, or scooping snow with either the top or bottom edge of the implement. FIG. 6 depicts a user's hands 100 holding the snow digging implement by the hand holes 22 with the top or short edge 18 down so as to be able to dig hard snow by pulling in the direction of arrow 104, and with the bottom or long edge 20 up so as to be able to shovel light or soft snow by pushing away from the user's body in the direction of arrow 102.

When using the implement for digging, scooping or shoveling, the user applies inward pressure by pushing the hands together in the direction of arrows 105. This pressure causes the sheet 12 to curve about its center, along an axis passing through the center of the top 18 and bottom 20 of the sheet. When the user thus forms the sheet into a curved configuration, its strength in a direction parallel to the axis of curvature will increase because the moment of inertia of the cross section of the implement taken perpendicular to that axis increases. Up to a point, the greater the amount of curvature, the stronger will be the shape of the implement. The amount of pressure and thus the amount of curvature created in the sheet will vary depending on the strength of the user and the condition of the snow to be moved. FIG. 7 shows a user digging hard snow 106 with the short edge of the implement in the manner described.

Figure 8B:
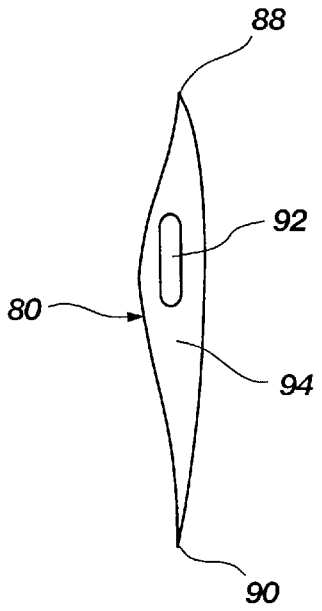
FIGS. 8A and 8B show a front and side view of an alternative embodiment of the present invention suitable for being formed by injection molding.
Figure 8A:
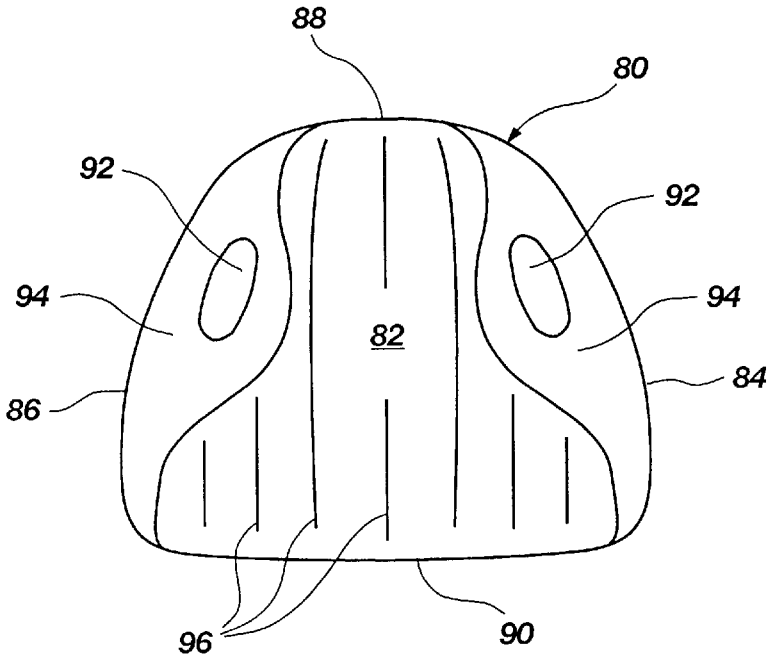

FIGS. 8A and 8B depict an alternative embodiment of a snow digging implement especially suitable for forming by injection molding. As shown in FIG. 8A, the implement 80 is formed of a substantially rigid polymer material such as polyethylene, polystyrene, or nylon, and is comprised of a substantially flat body 82, a right side 84 and a left side 86, a top edge 88 and a bottom edge 90. As with the other embodiments, the top edge 88 is short and curved to cut hard or packed snow, while the bottom edge 90 is longer and flatter to cut and shovel soft or light snow. For added strength, the face of the body 82 is provided with ridges 96 formed therein. Such ridges for strengthening flat bodies are well known in the art, and are commonly used on shovels of various designs. For a snow digging implement constructed as shown in FIG. 8A having the preferred general size and thickness noted for the implement of FIG. 1, the entire implement will have a total weight of slightly less than 12 oz. when the approximate dimensions are converted using typical density values for HDPE known to those skilled in the art.

The principle difference between the embodiment of FIG. 8A and the other embodiments is the inwardly curved, shell-like design. The sides 84 and 86 do not terminate at the edges of the implement, but curve back over the body 82 and toward the center thereof as integrally formed flaps 94. Formed in these flaps are hand holes 92 which allow a user to grasp the implement in a manner similar to that described above. This arrangement is shown clearly by comparison of the front view of FIG. 8A and the side view of FIG. 8B. Among other advantages, this shell-like configuration helps hold snow on the implement when scooped, which improves the ease and efficiency of shoveling and moving relatively soft snow.

Figure 9:
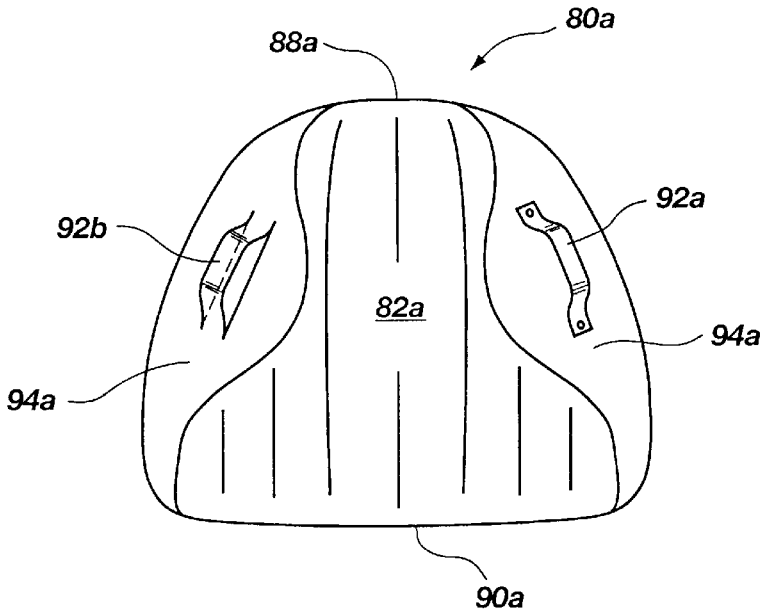
FIG. 9 shows the embodiment of FIG. 8A wherein a separately formed handle is affixed to the right inwardly directed flap of the implement, and a raised handle integrally formed from the material of the inwardly directed flap is disposed on the left flap.

As with the other embodiments of this invention, it will be apparent to one skilled in the art that there are many methods of providing suitable handholds for the embodiment of FIG. 8A. FIG. 9 shows the embodiment of FIG. 8A wherein a separately formed handle 92*a* like those described relative to FIG. 3 is affixed to the right inwardly directed flap 94*a* of the implement 82*a*, and a raised handle 92*b* integrally formed from the material of the flap like those described relative to FIG. 4 is disposed on the left flap 94*a*.

Figure 10:
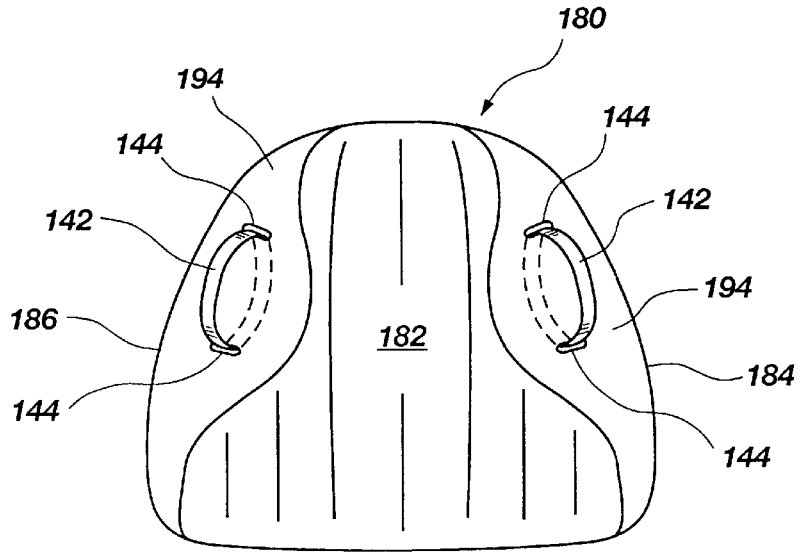
FIG. 10 shows the embodiment of FIG. 8A wherein the handles comprise continuous straps disposed through pairs of parallel openings formed in the inwardly directed flaps.

Alternatively, FIG. 10 shows the embodiment of FIG. 8A wherein the handles comprise continuous straps disposed through pairs of openings formed in the inwardly directed flaps. The implement 180, similar to that of FIG. 8A, comprising a substantially rigid, inwardly curved, shell-like design, has sides 184 and 186 which curve back over the body 182 and toward the center thereof as integrally formed flaps 194. Formed in these flaps are pairs of small openings 144, through which extend continuous straps 142, similar to those shown in FIG. 2. These straps are oriented generally parallel to the sides of the implement 180, and are preferably formed of a strong, flexible material such as nylon that is easily grasped by a user's hands.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. An implement for digging snow, comprising:

a substantially flat continuous sheet of flexible, resilient material having a top edge, a bottom edge, a right edge, a left edge, and an elongate axis between said top edge and said bottom edge, the top edge comprising a continuous smooth outward curve in the plane of the sheet which is shorter and more rounded than the bottom edge; and grasping means disposed near the right edge and the left edge of said flat sheet, said grasping means having elongate axes which are oriented generally parallel to said right and left edges and generally parallel to the elongate axis of said flat sheet, whereby a user grasping the sheet by the grasping means may selectively deform the sheet about said elongate axis by means of inward pressure exerted upon said grasping means, so as to form said sheet into an arc along a cross-section taken generally perpendicular to said elongate axis, thereby forming said sheet into a shovel head shape to cut and transport volumes of snow using the top edge or bottom edge.

2. The implement as described in claim 1 wherein said grasping means comprises first and second oblong openings formed near the right edge and left edge of the sheet respectively, said openings being of a size sufficient to allow grasping by a human hand.

3. The implement as described in claim 1 wherein said grasping means comprises a first handle disposed on said flat sheet near the right edge thereof, a second handle disposed on said flat sheet near the left edge thereof, said handles being configured to allow grasping by a human hand, and being selected from the group comprising raised handles integrally formed from the material of the sheet, raised handles attached to the sheet, and continuous straps disposed through a first pair of parallel openings formed near the right edge of said sheet and a second pair of parallel openings formed near the left edge of said sheet.

4. The implement as described in claim 3 wherein said raised handles which are attached to the sheet are attached by means selected from the group comprising adhesive and mechanical fasteners.

5. The implement as described in claim 1 further comprising first and second integrally formed ears extending from the right edge and the left edge respectively of said sheet, and wherein said grasping means are disposed on said ears.

6. The implement as described in claim 5 wherein said grasping means comprises first and second oblong openings formed in said ears, said openings being of a size sufficient to allow grasping by a human hand.

7. The implement as described in claim 5 wherein said grasping means comprises a first handle disposed on the ear extending from the right edge of said sheet, a second handle disposed on the ear extending from the left edge of said sheet, said handles being configured to allow grasping by a human hand, and being selected from the group comprising raised handles integrally formed from the material of the sheet, raised handles attached to the ears, and continuous straps disposed through a first pair of parallel openings formed in the right ear and a second pair of parallel openings formed in the left ear.

8. The implement as described in claim 7 wherein said raised handles which are attached to the ears are attached by means selected from the group comprising adhesive and mechanical fasteners.

9. The implement as described in claim 1 wherein said flat sheet is formed of a material selected from the group comprising polypropylene, polyethylene, high density polyethylene, and polystyrene.

10. The implement as described in claim 1 wherein the dimensions of the flat sheet are approximately 1 foot long by 1 foot wide.

11. The implement as described in claim 1 wherein said flat sheet is of a size and thickness such that the implement weighs less than 4 ounces.

12. The implement as described in claim 1 wherein the flat sheet is formed having dimensions such as to allow it to be stored in a container selected from the group comprising a snowmobile underseat compartment, a backpack, a daypack, and a fannypack.

13. A method of cutting, digging, scooping, or shoveling snow, comprising the steps of:

obtaining a substantially flat continuous sheet of flexible, resilient material having a top edge, a bottom edge, a right edge, and a left edge, and an elongate axis between said top edge and said bottom edge;

grasping said sheet by grasping means situated near said right edge and said left edge;

deforming the sheet about its elongate axis into a shovel head shape by exerting inward pressure upon said grasping means so as to form said sheet into a curved surface about said elongate axis; and cutting and transporting volumes of snow by cutting the snow with the top edge or bottom edge of said sheet, and lifting or pushing the snow with the sheet.

14. An implement for digging snow, comprising:

a continuous shell formed of flexible, resilient material, having a curved top edge, a curved bottom edge, a right side and a left side, a rearward portion that is substantially flat, an elongate axis between said top edge and said bottom edge, the top edge and bottom edge being outwardly curved along said elongate axis in the plane of the rearward portion, and a forward portion comprising first and second inwardly directed flaps integrally formed with and extending inward from the right side and left side respectively;

grasping means disposed on the inwardly directed flaps whereby a user grasping the shell by the grasping means may use it to cut and transport volumes of snow by means of the top edge or bottom edge; and wherein said curved top edge is shorter and more rounded compared to said curved bottom edge, such that said top edge will be suited to cut relatively hard or packed snow, and said bottom edge will allow for the transport of a larger amount of softer or loosened snow.

15. The implement as described in claim 14 wherein said grasping means comprises first and second oblong openings formed in the first and second inwardly directed flaps, said openings being oriented with their long axes generally parallel to the nearest side of said shell and being of a size sufficient to allow grasping by a human hand.

16. The implement as described in claim 14 wherein said grasping means comprises a first handle disposed on the inwardly directed flap on the right side, and a second handle disposed on the inwardly directed flap on the left side, said handles being configured to allow grasping by a human hand, and being selected from the group comprising raised handles integrally formed from the material of the inwardly directed flaps, raised handles attached to the inwardly directed flaps, and continuous straps disposed through a first pair of parallel openings formed in the first inwardly directed flap and a second pair of parallel openings formed in the second inwardly directed flap.

17. The apparatus as described in claim 16 wherein said raised handles which are attached to the inwardly directed flaps are attached by means selected from the group comprising adhesive and mechanical fasteners.

18. The implement as described in claim 14 wherein said shell is formed of material selected from the group comprising polypropylene, polyethylene, high density polyethylene, and polystyrene.

19. The implement as described in claim 14 wherein said implement is formed by means of injection molding.

20. The implement as described in claim 19 wherein said shell is approximately 1 foot long by 1 foot wide and weighs less than 12 ounces.

* * * * *